US005356147A

United States Patent [19]

MacDonald

[11] Patent Number: 5,356,147

[45] Date of Patent: Oct. 18, 1994

[54] GOLF PRACTICE DEVICE

[76] Inventor: Donald K. MacDonald, 1180 Kilkere Rd., Sunol, Calif. 94586

[21] Appl. No.: 6,826

[22] Filed: Jan. 21, 1993

Related U.S. Application Data

[63] Continuation-in-part of Ser. No. 931,598, Aug. 18, 1992, abandoned.

[51] Int. Cl.[5] ..... A63B 69/36

[52] U.S. Cl. ..... 273/195 A

[58] Field of Search ..... 273/195 A, 176 J, 195 B

[56] References Cited

U.S. PATENT DOCUMENTS

| | | | |
|---|---|---|---|
| 3,423,096 | 1/1969 | Tone | 273/195 A |
| 3,712,628 | 1/1973 | Boss | 273/195 B X |
| 4,928,966 | 5/1990 | Miller | 273/195 A |
| 4,932,663 | 6/1990 | Makar | 273/176 J X |
| 5,026,580 | 6/1991 | Hammon | 273/195 A X |

*Primary Examiner*—George J. Marlo

*Attorney, Agent, or Firm*—Fliesler, Dubb, Meyer & Lovejoy

[57] ABSTRACT

An apparatus for practicing a golf swing is described comprising a sheet of simulated grass material having its own backing attached to a separate underlying sheet of substantially inelastic material, such as nylon, which is suspended above an open space for supporting a golf ball. The supporting apparatus comprises a pair of spaced rail members and a pair of spaced risers over which the sheet or combination of sheets is suspended. In use, the ball supporting sheet or combination of sheets is depressed when struck by the head of a golf club when the club is swung "through" a ball in a manner which normally would result in making a divot in the natural turf of a golf course. The apparatus may also be used with a conventional wooden or plastic tee.

18 Claims, 7 Drawing Sheets

GOLF PRACTICE DEVICE

CROSS-REFERENCE TO RELATED APPLICATIONS

The present application is a continuation-in-part of application Ser. No. 07/931,598, filed Aug. 18, 1992, entitled APPARATUS FOR USE IN PRACTICING A GOLF SWING, now abandoned.

BACKGROUND OF THE INVENTION

1. Field of the Invention

The present invention relates to golfing apparatus for use in practicing golf swings in general and in particular to a method and apparatus for use in practicing a golf swing in which an iron or a wood is used for hitting "through" a golf ball in a manner which normally would result in making a divot in the natural turf of a golf course.

2. Description of the Related Art

Driving ranges are provided to enable golfers to practice their golf swings using their woods and their irons. A typical driving range comprises a rectangular plot of ground which may be 350 to 400 yards in length, or longer, space permitting, and of sufficient width to accommodate a number of golfers at the same time. Typically, each golfer is allotted a predetermined amount of practice space within which he or she can safely swing their club to hit a golf ball down the driving range. The golfer may hit their ball from a wooden or plastic tee or from the surface of the practice space. When the golfer uses a tee, the golfer's swing should be and usually is identical to that which the golfer uses during normal play. However, heretofore, when the golfer has not used a tee and has hit a ball from the surface of a practice space, the golfer usually has been required to adjust his or her swing to accommodate the conditions of the surface of the practice space.

The nature of the surface of the practice space can vary widely at any given driving range and from driving range to driving range. For example, the surface may comprise grass covered turf which is substantially identical to the conditions which the golfer would normally encounter on a conventional golf course fairway. Under such conditions the golfer can and normally would utilize his or her normal swing which, when using an iron and sometimes when using a wood, requires that the club head be driven downwardly and "through" the ball resulting in making a divot at the apex of the swing arc, i.e. the removal of an amount of turf from below the ball after the ball is struck. Unfortunately, such ideal conditions are not found at many driving ranges.

The surface of the practice space at many driving ranges which comprises turf is typically dry and hard, and riddled with divot marks after a short period of use, making it difficult to find a patch of useful grass or even a smooth surface on which to rest the ball. At other driving ranges, the surface of the practice space may comprise a hard rubber mat, with or without a simulated grass surface, or the like. Under such conditions, it has not been possible heretofore to practice swinging an iron or wood "through" a ball in a manner which usually would result in making a divot during a normal fairway shot.

Practice driving apparatus for home use is commercially available. Typically it comprises a mat from which a ball is struck and a net into which the ball is hit.

As in the case of prior known commercial driving ranges which use a mat from which a ball is struck as discussed above, prior known home practice driving apparatus also does not ordinarily permit swinging an iron or a wood "through" a ball as is usually required during a normal fairway iron shot.

SUMMARY OF THE INVENTION

In view of the foregoing, principal objects of the present invention are a method and apparatus for practicing golf swings in general and in particular for practicing golf swings with an iron and wood which allows hitting "through" a ball in a manner which would normally result in making a divot in the natural turf of a conventional golf course.

In accordance with the above objects there is provided in each of the embodiments of the present invention an apparatus for use in practicing a golf swing comprising a means for supporting a golf ball which is capable of being elastically deformed when struck by the head of an iron or wood being swung "through" the golf ball in a manner which would normally result in making a divot in the natural turf of a golf course.

In one embodiment of the present invention the ball supporting means comprises a rectangular sheet of elastic material which is attached at both ends to corresponding ends of a rectangular frame.

In another embodiment of the present invention the ball supporting means comprises a rectangular sheet of substantially inelastic material. In this embodiment preferably both ends of the sheet of inelastic material are resiliently attached to corresponding ends of the rectangular frame as by an elastic member, e.g. spring or the like. The sheet may comprise a simulated grass surface or support a separate sheet comprising a simulated grass surface.

In another embodiment of the present invention a rectangular sheet of material is supported on a plurality of substantially inelastic elongated members such as cords or strips having circular or rectangular cross-sections. In this embodiment preferably both ends of each of the cords or strips are resiliently attached to a corresponding opposite end of the frame as by an elastic member, e.g. a spring, or the like. If the cords or strips are elastic they may be attached directly to the frame without springs. The ends of the sheet of material supported on the cords or strips are also attached to the ends of the frame with or without elastic members, depending on whether or not the sheet is sufficiently elastic. Preferably, one end of the sheet is fixedly attached to one end of the frame and the opposite end thereof is resiliently attached to the opposite end of the frame.

In another embodiment of the present invention there is provided a resilient container for containing a compressible gas such as air. The upper surface of the container may be provided with a simulated grass surface or, alternatively, a separate sheet of material may be provided to lie on top of the resilient gas container. In this embodiment, a frame is used to contain the resilient gas container so as to prevent its horizontal movement when struck by a golf club.

In still another embodiment of the present invention there is provided a pair of spaced elongated rigid rail members. A riser having a curved top edge is mounted across and near to the ends and perpendicular to the longitudinal axis of the risers for supporting a sheet of simulated grass affixed to a sheet of nylon. The nylon and grass sheets are elastically supported on the risers by a plurality of springs.

In each of the above described embodiments there may also be provided a means for receiving and supporting a conventional wooden or plastic golf tee, or the like, in a vertical position so that the apparatus can be used for practicing hitting a ball from a tee.

BRIEF DESCRIPTION OF THE DRAWINGS

The above and other objects, features and advantages of the present invention will become apparent from the following detailed description of the accompanying drawings, in which.

DETAILED DESCRIPTION OF THE INVENTION

Figure 1:
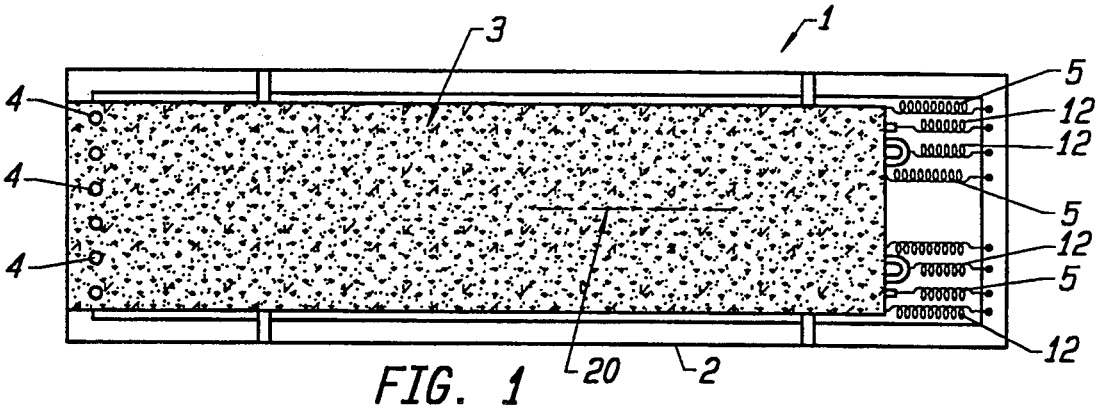
FIG. 1 is a top plan view of an embodiment of the present invention.
Figure 2:
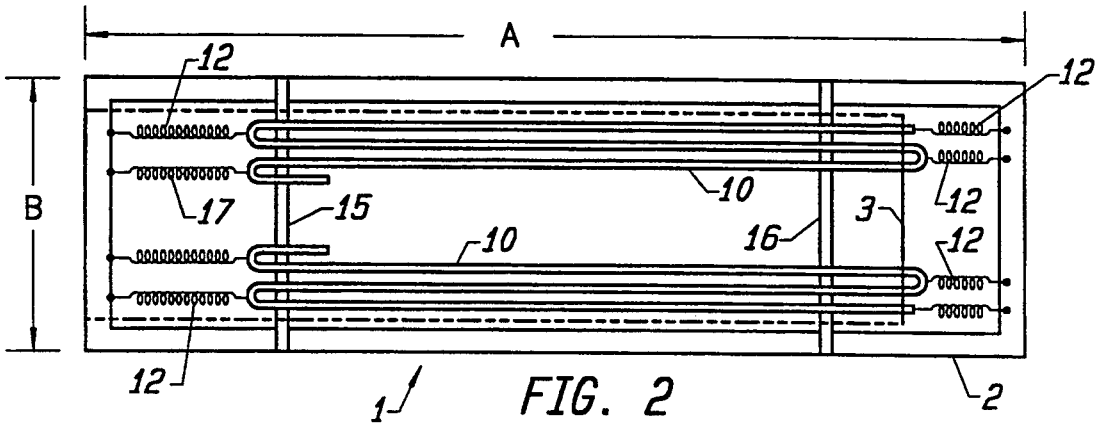
FIG. 2 is a top plan view of the embodiment of FIG. 1 with the top sheet removed therefrom in order to expose underlying elongated supporting members disposed therein.
Figure 3:
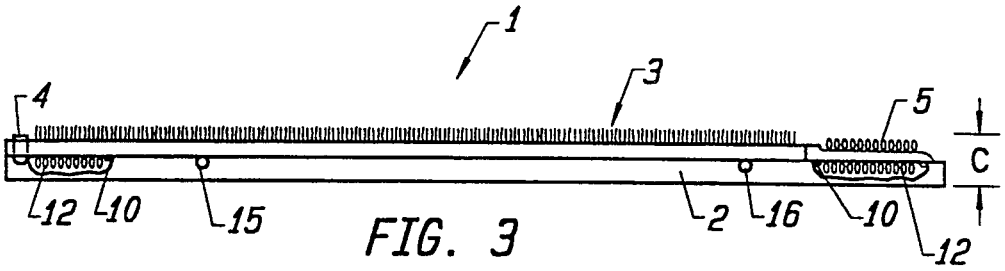
FIG. 3 is a side elevation view of the embodiments of FIGS. 1 and 2.

Referring to FIGS. 1–3, there is provided in accordance with the present invention an apparatus designated generally as 1 for use in practicing a golf swing. In the apparatus 1 there is provided a rectangular frame 2 and a rectangular sheet of material 3 for supporting a golf ball which is capable of being elastically deformed when struck by the head of an iron or wood being swung "through" the golf ball in a manner which would normally result in making a divot in the natural turf of a golf course. The frame may be made of wood, metal, plastic or other suitable material. One end of the sheet 3 is fixedly attached to an end of the frame 2 as by nails, screws or other suitable fittings 4. The opposite end of the sheet 3 preferably the end toward which a ball is driven is resiliently attached to the opposite corresponding end of the frame 2 as by a plurality of spring members 5.

Beneath the sheet 3 there is provided a plurality of elongated support members 10. Both ends of each of the support members 10 are attached to corresponding ends of the frame 2 by an elastic member 12, such as a spring or the like. It should be understood that the support members 10 may comprise individual support members or a single support member which is threaded back and forth across the interior of the frame 2 as shown in FIG. 2. Additionally, the support members 10 may comprise either a cord or filament having a circular cross-section or a strap-like member having a rectangular cross-section. For example, the members 10 having a circular cross-section may comprise nylon cords or lines having a diameter of from $\frac{1}{8}$ inch to $\frac{1}{4}$ inch. If the supporting members 10 comprise strap-like members having a rectangular cross-section, they may be, for example, $\frac{1}{8}$ inch to $\frac{1}{4}$ inch thick and from 1 inch to 2 inches wide.

Figure 7:
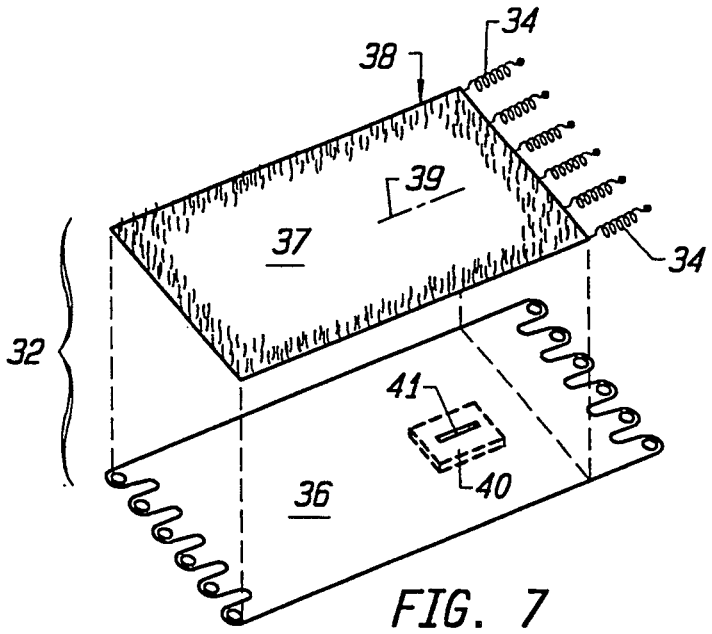
FIG. 7 is an exploded perspective view of the top member of the embodiment of FIG. 6.
Figure 9:
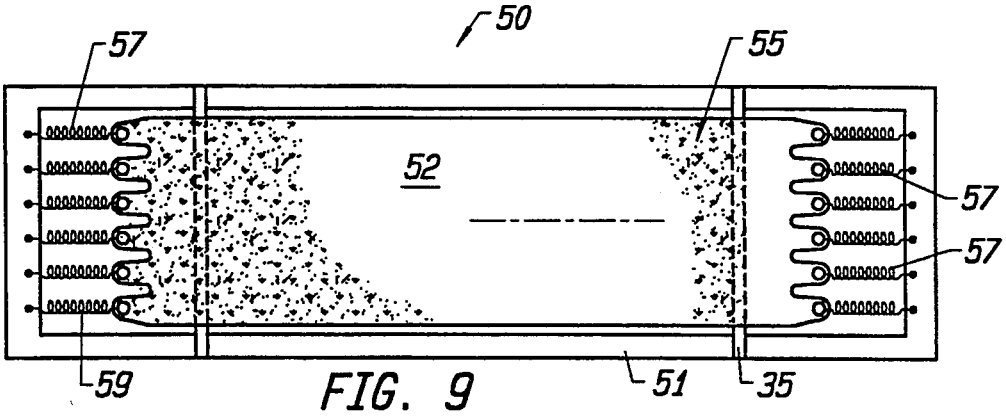
FIG. 9 is a plan view of another embodiment of the present invention.

In another embodiment of the present invention, the members 10 may be replaced by a single rectangular sheet of elastic material fixedly attached at both ends to the frame 2 as seen in FIG. 7, or a single rectangular sheet of inelastic material resiliently attached at both ends to the frame 2 as by springs, as seen in FIG. 9.

Extending transverse the longitudinal axis of and a predetermined distance inwardly from the ends of the frame 2 there is provided a pair of supporting rods 15 and 16. The rods 15 and 16 are provided for supporting the elongated supporting members 10 and the sheet 3 such that the upper surface of the sheet 3 lies above the plane of the upper surface of the frame 2 as shown in FIG. 3.

In a typical embodiment of the present invention as shown in FIGS. 2 and 3, the length A of the frame 2 is approximately 30 inches, the width B is approximately 16 inches and the height C is approximately 1 inch.

Figure 5:
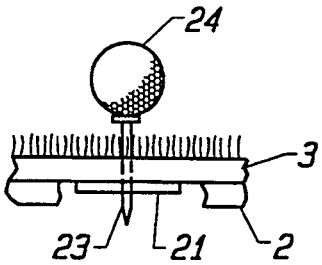
FIG. 5 is a side elevation view of a golf ball being held on the tee receiving and retaining pad of FIG. 4.

Located along and extending through the midline of the sheet 3 to the right of center as shown in FIG. 1 there is provided a 3 inch to 4 inch long slit 20. Below the slit 20 there is provided a pad 21 which is attached to the sheet 3 as by cement or any other suitable means as shown in FIG. 5. The pad 21 is also provided with a slit or slot 22 which corresponds to and is placed in registration with the slit 20 in the sheet 3.

The slits 20 and 22 are provided for receiving and supporting a wooden or plastic tee 23 inserted therein on which may be placed a golf ball 24. The pad 21 is typically 5 inches square, $\frac{1}{4}$0 inch thick and made of a resilient material such as rubber, or the like, which supports the tee 23 in a vertical position as by friction.

Figure 6:
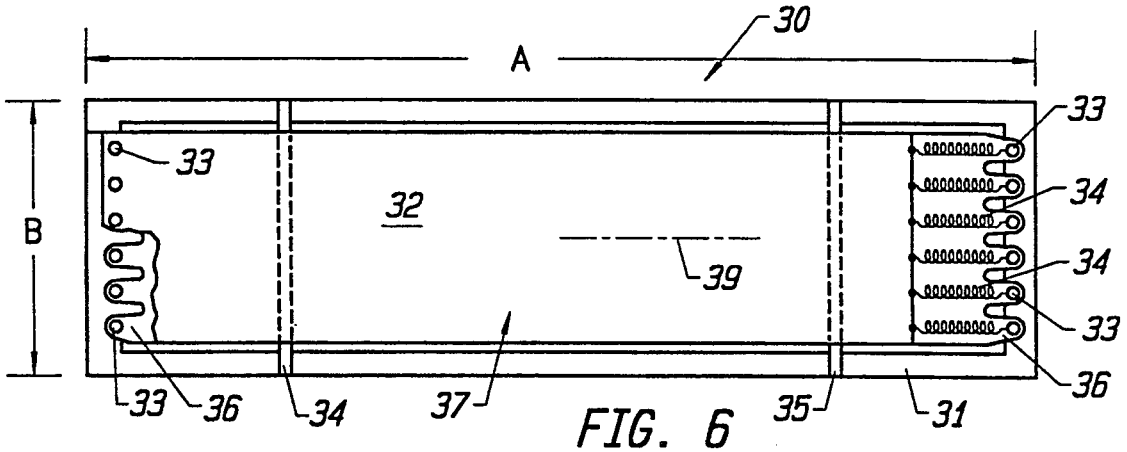
FIG. 6 is a top plan view of another embodiment of the present invention.
Figure 8:
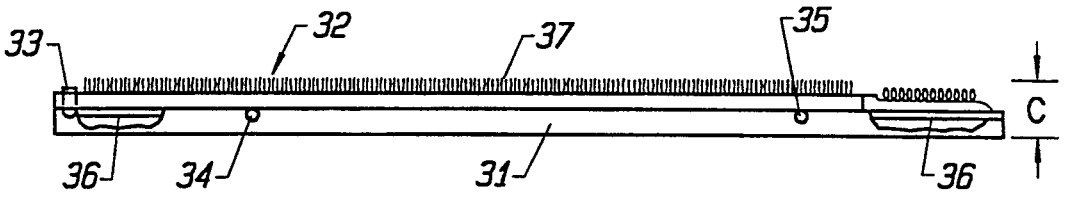
FIG. 8 is a side elevation view of the embodiment of FIG. 6.

Referring to FIG. 6–8, there is provided in another embodiment of the present invention an apparatus designated generally as 30 for practicing a golf swing. In the apparatus 30 there is provided a rectangular frame 31 and a rectangular ball supporting assembly 32. The frame 31 may be identical to the frame 2 of FIGS. 1 and 2. Extending transverse the longitudinal axis of the frame 31 and sheet 32 there is provided a pair of supporting bars 34 and 35. Bars 34 and 35 are located a predetermined distance inwardly from the ends of the frame 31 for supporting the assembly 32 such that the upper surface of the assembly 32 lies in a plane above the plane of the upper surface of the frame 31 as described above with respect to the embodiment of FIGS. 1–3.

As shown more clearly in FIG. 7, the assembly 32 comprises a rectangular bottom sheet 36 and a rectangular top sheet 37. The sheet 37 is in the nature of a relatively thin mat having a simulated grass surface 38. Both ends of the sheet 36 are fixedly attached to corresponding ends of the frame 31 as by fittings 33, e.g. nails, screws or the like. One end of the sheet 37 is attached to a corresponding end of the frame 31 by means of the fittings 33. The opposite end of the sheet 37 is attached to the corresponding end of the frame 31 as by elastic members 34, e.g. springs or the like, and fittings 33.

Located along the midline of the member 32 to the right of the center thereof there is provided an elongated slot 39 as seen in FIG. 7 which corresponds to the slot 20 in the sheet 3 of FIG. 1. Affixed to the sheet 36 there is provided a resilient pad 40 with a corresponding slot 41 which is placed in registration with the slot 39 for supporting a golf tee as by friction, as described above with respect to the rubber pad 21 in FIGS. 4 and 5.

In the embodiment of FIGS. 6–8, the sheet 36 is sufficiently elastic so that it can be elastically deformed when struck by the head of an iron or a wood as will be further described below and therefore does not require the use of springs or other elastic members for attachment to the frame 31. The scalloped ends of the sheet 36 help to control the distribution of the tensile forces in the sheet. The sheet 37 may be inelastic and therefore the springs 34 are used to attach one end of the sheet 37 to the frame 31 to allow relative movement between the sheets 36 and 37 while keeping both sheets under tension. The overall dimensions of the apparatus 30 are the same as for the apparatus 1.

Figure 10:
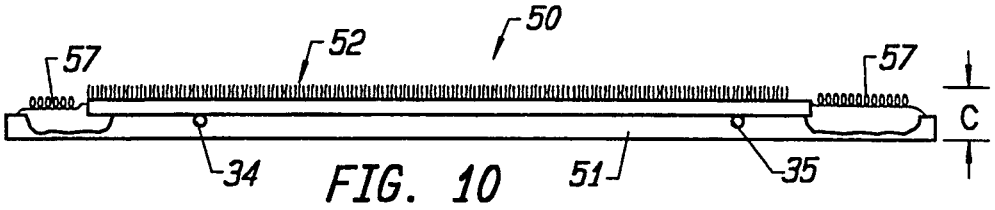
FIG. 10 is a side elevation view of the embodiment of FIG. 9.

Referring to FIGS. 9 and 10, there is provided in another embodiment of the present invention an apparatus designated generally as 50 for use in practicing a golf swing. In the apparatus 50 there is provided a rectangular frame 51 and a rectangular sheet of material 52. The sheet of material 52 is substantially identical to the sheet 36 of FIG. 7 except that the sheet 52 may comprise a simulated grass surface 55 and is substantially inelastic. Consequently, the sheet 52 is attached at both ends to the frame 51 by a resilient attaching member 57, such as a spring. Typically the sheet 52 comprises a sheet of nylon. In all other respects the apparatus of FIGS. 9 and 10 is substantially identical to the apparatus described above with respect to FIGS. 6–8.

Figure 11:
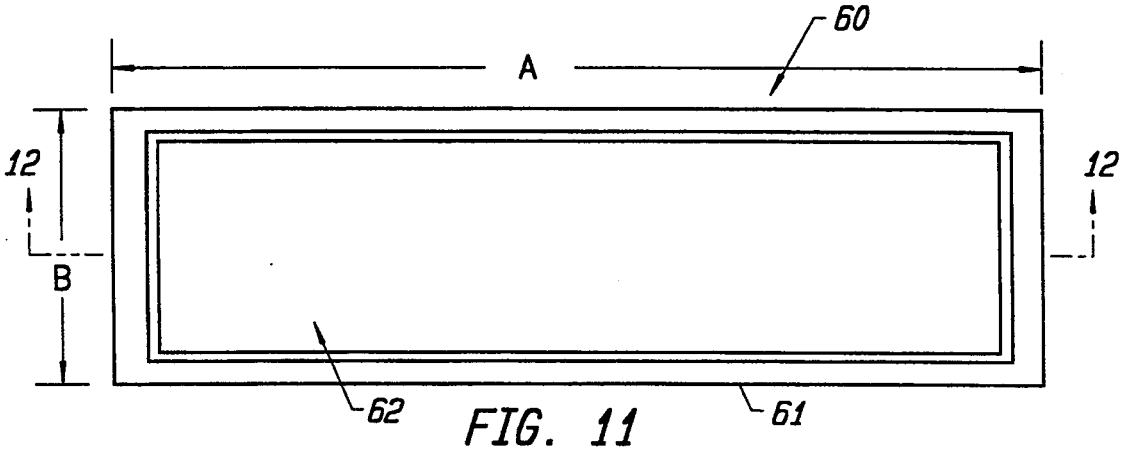
FIG. 11 is a top plan view of still another embodiment of the present invention.
Figure 12:
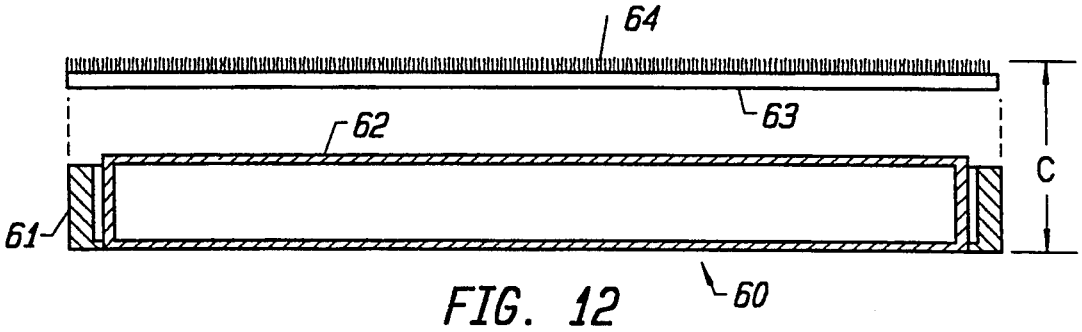
FIG. 12 is a cross-sectional view taken in the direction of the arrows 12—12 in FIG. 11.

Referring to FIGS. 11 and 12, there is provided in still another embodiment of the present invention an apparatus designated generally as 60 for use in practicing a golf swing. In the apparatus 60 there is provided a rectangular frame 61. Within the periphery of the frame 61 there is provided a resilient container 62 for containing a compressible gas, such as air. The container 62 is located within the periphery of the frame 61 so as to restrain horizontal movement of the apparatus 60 when struck by a club. A thin mat or sheet 63 comprising a simulated grass surface 64 is provided to be laid over the upper surface of the container 62 and attached to the frame 61 by any suitable means, such as nails or screws. If the sheet 64 is sufficiently elastic, the ends of the sheet 64 are fixedly attached to the corresponding ends of the frame 61. If the sheet 64 is substantially inelastic, at least one end of the sheet 64 is resiliently attached to the frame 61 as by a suitable resilient member such as a spring, rubber band, or the like. The length A, width B and height C of the apparatus 60 are the same as for the previously described apparatus and the air pressure is such as to allow for the deformation of the sheet 64 and container 62 when it is struck by the head of a golf club, as will be described below.

Figure 13:
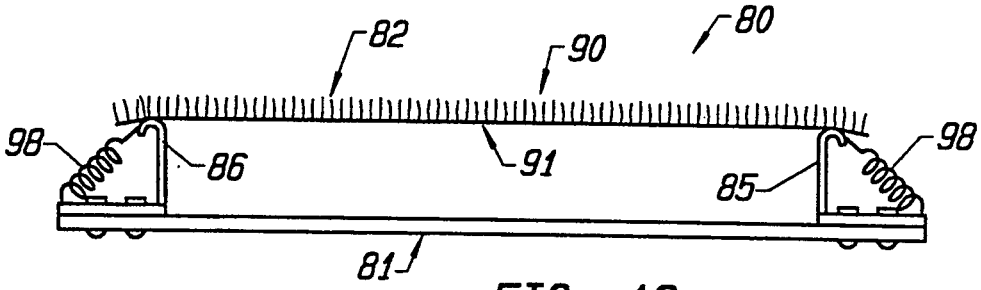
FIG. 13 is a side elevation view of an alternative embodiment of the present invention.

Referring to FIG. 13, there is provided in still another embodiment of the present invention a golf practice apparatus designated generally as 80. In the apparatus 80 there is provided a rail and riser assembly designated generally as 81 and an assembly designated generally as 82 comprising a sheet of simulated grass 90 affixed to a sheet of nylon 91.

Figure 14:
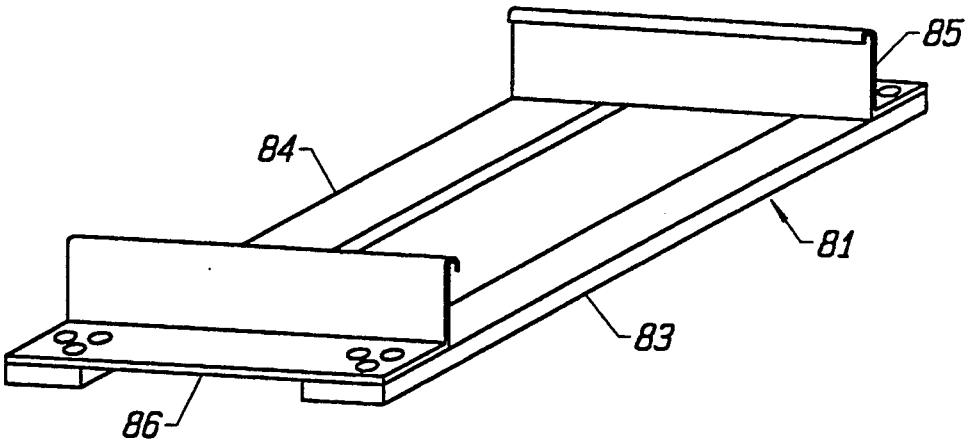
FIG. 14 is a perspective view of the rails and riser assembly of FIG. 13.

Referring to FIG. 14, there is provided in the rail and riser assembly 81 a pair of rigid rail members 83 and 84 and a pair of riser members 85 and 86.

Figure 15:
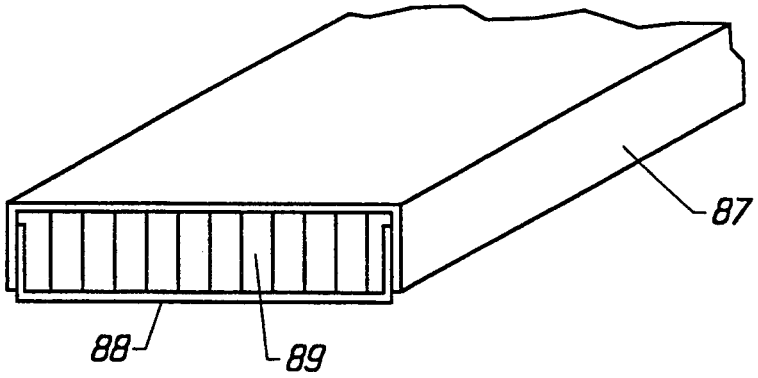
FIG. 15 is a partial perspective view of the end of one of the rails of the assembly of FIG. 14.
Figure 16:
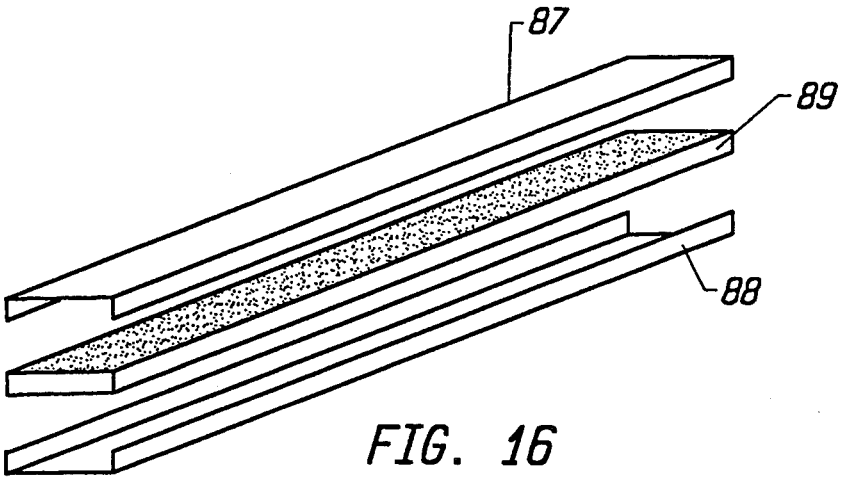
FIG. 16 is an exploded perspective view of one of the rails of FIG. 14.

Referring to FIGS. 15 and 16, there is provided in each of the rail members 83 and 84 a pair of U-shaped extruded aluminum channel members 87 and 88. Each of the members 87 and 88 is approximately 3 to 4 inches wide and 36 to 46 inches long, has a wall thickness of approximately 40–60 mils and a honeycomb core member 89. The width of the channel member 88 is such that it fits snugly within the side walls of the channel member 87 to enclose the honeycomb core member 89 as shown in FIG. 15. The core member 89 comprises a phenolic impregnated honeycomb core such as made by Verticel, Inglewood, Calif.

Figure 18:
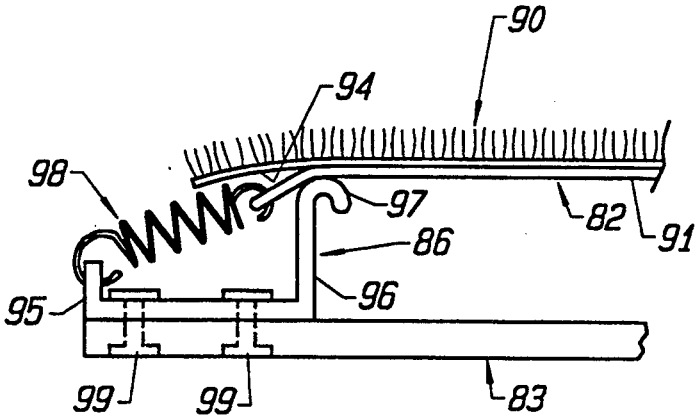
FIG. 18 is an enlarged partial elevation view of one end of the embodiment of FIG. 13.
Figure 17:
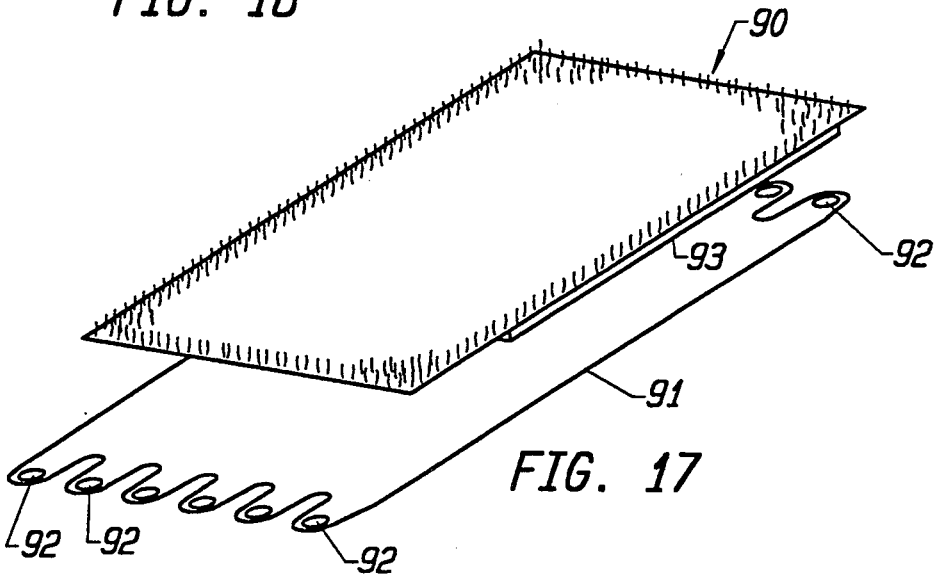
FIG. 17 is a an exploded perspective view of the simulated grass and nylon sheets of FIG. 13.

Referring to FIGS. 17 and 18, the sheet of simulated grass 90 is affixed to the sheet of nylon 91, as by a suitable adhesive 93, or being sewn thereto, or the like. The sheet of nylon 91 which is substantially inelastic may be 30–60 mils thick and the sheet of simulated grass 90 having its own backing 94 may be, for example, grass known as PROTURF II, No. 4557-02, sold by General Felt Industries, Saddle Brook, N.J. Each end of the sheet 91 comprises a plurality of grommeted holes 92 which are used for stretching the sheets 90 and 91 over the risers 85 and 86, as will be further described below. The length of the grass sheet 90 will be such that it extends an inch or two beyond the ends of the underlying nylon sheet 91 to conceal the grommets in the ends of the sheet 91.

Referring again to FIGS. 13 and 14 and to FIG. 18, the risers 85 and 86 are identical. Each of them comprises a relatively short side wall 95, as of 0.25 inches to 0.50 inches high, and a higher side wall 96, as of 0.75 inches to 1.5 inches high, the top of which is bent to form a curved surface 97 over which the sheets 90, 91 are stretched by means of a plurality of springs 98 located 2 inches apart. The side walls 95, 96 are approximately 3 to 5 inches apart. The springs 98 are inserted in the holes 92 in the ends of the sheet 91 and in holes provided therefor in the side wall 95 of each of the risers 85 and 86. The spring constant of the springs is such that it takes about 18 to 20 pounds of tension on the spring to obtain a 50% extension thereof. The risers 85 and 86 are attached to opposite ends of the rail members 83 and 84 approximately 30 to 36 inches apart as by a plurality of fittings 99 such as screws, bolts, or the like.

Figure 4:
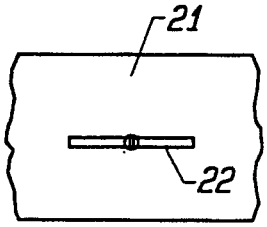
FIG. 4 is a top partial plan view of a slotted tee receiving and retaining pad according to the present invention.

The apparatus 80 of FIGS. 13–18 can also include the tee supporting means of FIGS. 4 and 5, if desired.

Figure 19:
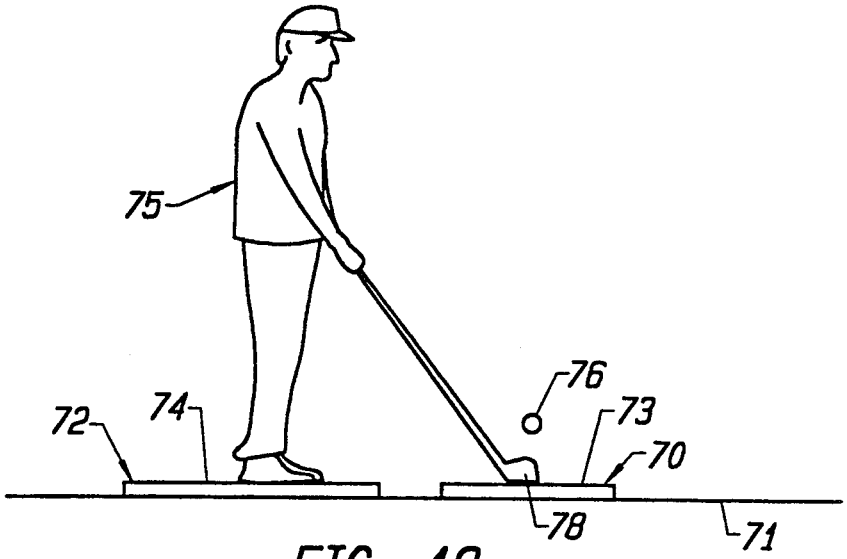
FIG. 19 is a view of a golfer illustrating the use of the embodiments of the present invention.
Figure 20:
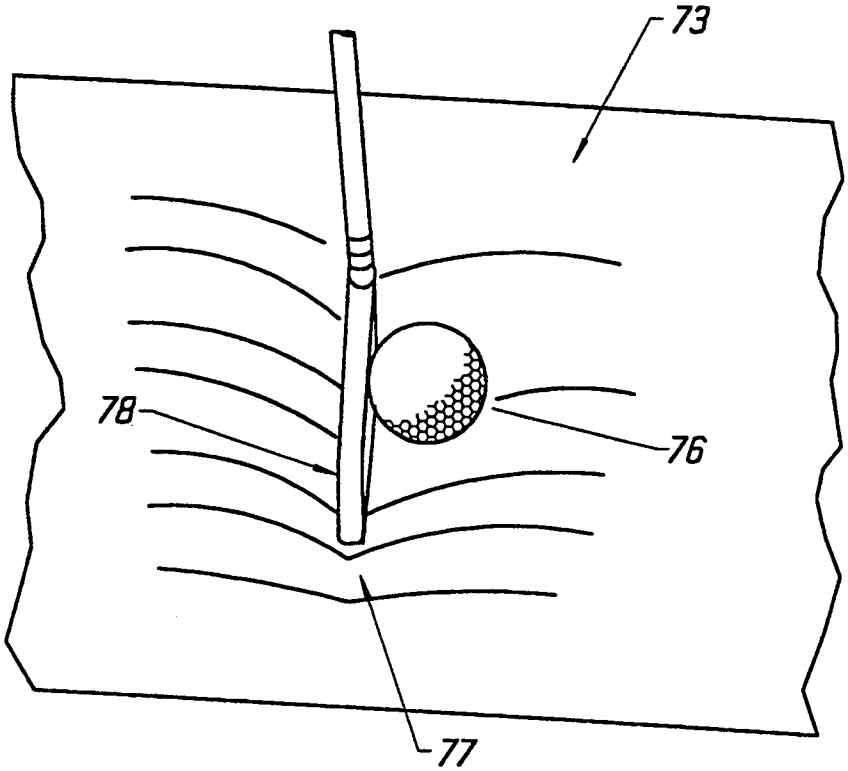
FIG. 20 shows the deformation of the ball supporting surface when struck by the head of an iron according to the present invention.

Referring to FIGS. 19 and 20, in use the apparatus of the present invention, herein designated generally as 70, is placed on a substantially horizontal surface 71. Adjacent to the apparatus 70 there is provided a mat, or the like, designated generally as 72. The thickness of the mat 72 is such that the upper surface 73 of the apparatus 70 lies in substantially the same plane as the upper surface 74 of the mat 72, as shown in FIG. 13. As will be appreciated, the upper surface 73 of the apparatus 70 corresponds to the upper surface of the sheet 3 of the apparatus of FIGS. 1–3, the upper surface of the sheet 32 of the apparatus of FIGS. 6–8, the upper surface of the sheet 52 of the apparatus of FIGS. 9–10 and the upper surface of the sheet 63 of the apparatus of FIGS. 11 and 12. Placing the upper surface of the apparatus 73 and mat 72 in the same plane closely approximates the conditions encountered on a flat level fairway. Of course, one or the other can be raised or lowered to simulate an uphill or downhill lie.

In practice, a golfer designated generally as 75 in FIG. 13 places a golf ball 76 on the surface 73 or on a tee in the manner described above and addresses the ball in the same manner as would be done on a tee or on a fairway of a conventional golf course. When simulating driving a ball from a tee located at the beginning of each fairway, the golfer typically places a wooden or plastic tee in the tee receiving slot described above and places a ball thereon as shown in FIG. 5. Under these circumstances, the golfer 75 ordinarily sweeps the ball supporting surface 73 to hit and propel the ball in a normal fashion. When using an iron, however, conventional golfing technique typically requires that the head of the iron be driven downwardly and "through" the ball, particularly when a shot is being made to a green. This may also be required in some shots with a wood. Such contact with the ball tends to impart backspin to the ball, causing the ball to "stick" on the green when it lands. Striking a ball in such a manner, however, typically produces a divot in the fairway. To permit hitting "through" a ball and thereby simulate this action, the ball supporting sheet and/or other supporting means in each of the embodiments of the present invention are provided to elastically deform as the club head 78 is driven downwardly, "through" the ball and into contact with the sheet as shown by the depression 77 of the surface of the sheet 73 in FIG. 15.

While preferred embodiments of the present invention are described above, it is contemplated that numerous modifications may be made thereto for particular applications without departing from the spirit and scope of the present invention. For example, while a typical length, width and height is provided for the embodiments described, these dimensions may be changed to suit particular users. Typically, the height of the apparatus is chosen to accommodate a typical amount of downward deformation of the ball supporting means when struck by an iron or a wood in a normal manner. If the suggested height is not appropriate for a given user, it may be changed. Accordingly, it is intended that the embodiments described be considered only as illustrative of the present invention and that the scope thereof should not be limited thereto but be determined by reference to the claims hereinafter provided.

What is claimed is:

1. An apparatus for practicing a golf swing comprising:

a rectangular frame assembly having a bottom surface;

a rectangular sheet of substantially inelastic supporting material;

a separate rectangular sheet of simulated grass having its own backing;

means for attaching the sheet of simulated grass with its own backing to the sheet of substantially inelastic supporting material;

means for attaching each end of the sheet of supporting material to the frame assembly so that the sheet of supporting material is suspended in position relative to the ends of the frame assembly with a predetermined amount of tension applied thereto a predetermined distance above said bottom surface of said frame assembly such that the sheet of supporting material with the sheet of simulated grass attached thereto is depressed when struck by the head of a golf club as the club head is swung "through" a golf ball placed on the sheet of simulated grass in a manner which normally would result in making a divot in the natural turf of a golf course.

2. An apparatus according to claim 1 wherein said rectangular frame assembly comprises:

a first and a second elongated spaced rail member;

a first and a second riser;

means for attaching the first and second risers to opposite ends of the first and second elongated spaced rail members, respectively, said first and second risers being orientated perpendicularly to the longitudinal axis of the first and second elongated spaced rail members; and means for suspending the rectangular sheet of supporting material with said predetermined amount of tension applied thereto over the top of the first and second risers.

3. An apparatus according to claim 1 wherein said sheet of supporting material comprises a layer of nylon material underlying said sheet of simulated grass material.

4. An apparatus according to claim 3 wherein said sheet of nylon material and said sheet of simulated grass material are bonded to each other.

5. An apparatus according to claim 3 wherein said sheet of nylon material and said layer of simulated grass material are sewn together.

6. An apparatus according to claim 3 wherein the opposite ends of said sheet of simulated grass material extend a predetermined distance beyond the corresponding ends of said sheet of nylon material.

7. An apparatus according to claim 1 wherein said means for suspending said sheet of supporting material over the top of the first and second risers comprises a resilient member attached to at least one end of said rectangular sheet of supporting material.

8. An apparatus according to claim 7 wherein said resilient member comprises a spring member.

9. An apparatus according to claim 1 wherein each of said first and second risers comprises a U-shaped channel member having an interior wall and an exterior wall and wherein the interior wall of each of said U-shaped channel members is taller than said exterior wall and serves to support said rectangular sheet of supporting material said predetermined distance above said bottom surface of said frame assembly.

10. An apparatus according to claim 9 wherein the upper edge of the interior wall of each of said U-shaped channel members comprises a curved surface.

11. An apparatus according to claim 1 wherein each of said first and second risers comprises a U-shaped channel member having an interior wall and an exterior wall and wherein the exterior wall comprises means to which said stretching means is attached for suspending said rectangular sheets of supporting material and simulated grass over said interior wall.

12. An apparatus according to claim 11 wherein said suspending means comprises spring means.

13. An apparatus according to claim 1 wherein said first and said second elongated spaced rail member comprises a first and second U-shaped channel member between which is sandwiched a honeycomb core member.

14. An apparatus according to claim 13 wherein said honeycomb core member comprises a phenolic impregnated paper honeycomb core.

15. An apparatus according to claim 1 wherein said means for attaching the sheet of simulated grass to the sheet of supporting material comprises means for adhesively bonding said sheet of simulated grass to said sheet of supporting material.

16. An apparatus according to claim 15 wherein said sheet of supporting material comprises nylon.

17. An apparatus according to claim 1 wherein said means for attaching the sheet of simulated grass to the sheet of supporting material comprises sewn threads.

18. An apparatus according to claim 17 wherein said sheet of supporting material comprises nylon.

* * * * *

UNITED STATES PATENT AND TRADEMARK OFFICE

CERTIFICATE OF CORRECTION

PATENT NO. : 5,356,147

DATED : October 18, 1994

INVENTOR(S) : Donald K. MacDonald

Figure 21:
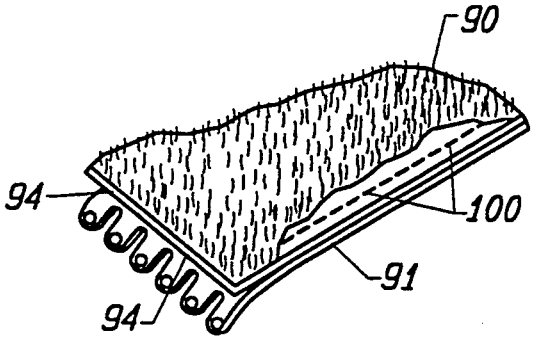
FIG. 21 is a partial view of the simulated grass and nylon sheets sewn together.

It is certified that error appears in the above-identified patent and that said Letters Patent is hereby corrected as shown below:

Column 6, line 36, after "sewn" insert --with threads 100--;
after "thereto" insert --as seen in Fig. 21--.
line 39, after "94" insert --as seen in Fig. 18--.
Column 7, line 21, change "FIG. 13" to --FIG. 19--.
Column 8, line 45, change "layer" to --sheet--.

Signed and Sealed this

Second Day of January, 1996

*Attest:*

Bruce Lehman

BRUCE LEHMAN

*Attesting Officer*

*Commissioner of Patents and Trademarks*